US010041662B2

(12) United States Patent
Sonneman

(10) Patent No.: US 10,041,662 B2
(45) Date of Patent: Aug. 7, 2018

(54) LIGHT BAR FOR A LIGHTING SYSTEM

(71) Applicant: Robert A. Sonneman, Mamaroneck, NY (US)

(72) Inventor: Robert A. Sonneman, Mamaroneck, NY (US)

( * ) Notice: Subject to any disclaimer, the term of this patent is extended or adjusted under 35 U.S.C. 154(b) by 0 days.

(21) Appl. No.: 15/407,085

(22) Filed: Jan. 16, 2017

(65) Prior Publication Data

US 2018/0128464 A1 May 10, 2018

Related U.S. Application Data

(60) Provisional application No. 62/419,505, filed on Nov. 9, 2016.

(51) Int. Cl.

| | |
|---|---|
| ***F21V 21/35*** | (2006.01) |
| ***F21S 8/06*** | (2006.01) |
| ***F21V 23/06*** | (2006.01) |
| ***F21S 2/00*** | (2016.01) |
| ***F21V 23/02*** | (2006.01) |
| ***F21S 4/28*** | (2016.01) |
| ***F21V 19/04*** | (2006.01) |
| *F21Y 115/10* | (2016.01) |

(Continued)

(52) U.S. Cl.

CPC ..... *F21V 21/35* (2013.01); *F21S 2/005* (2013.01); *F21S 4/28* (2016.01); *F21S 8/061* (2013.01); *F21S 8/063* (2013.01); *F21V 19/04* (2013.01); *F21V 23/02* (2013.01); *F21V 23/06* (2013.01); *F21V 21/104* (2013.01); *F21Y 2103/10* (2016.08); *F21Y 2115/10* (2016.08)

(58) Field of Classification Search

CPC ..... F21V 21/35; F21V 19/04; F21V 19/0085; F21V 21/34; F21S 4/28; F21S 2/005; F21S 8/066; F21S 8/038; F21S 8/061; F21S 8/063

See application file for complete search history.

(56) References Cited

U.S. PATENT DOCUMENTS

| | | | |
|---|---|---|---|
| 2,292,395 | A | 8/1942 | O'Brien |
| D217,785 | S | 6/1970 | Wolff |
| D222,748 | S | 12/1971 | Strianese |

(Continued)

FOREIGN PATENT DOCUMENTS

| | | | |
|---|---|---|---|
| CN | 200 986 123 | Y | 12/2007 |
| DE | 8708815 | U1 | 11/1987 |

(Continued)

OTHER PUBLICATIONS

Patent Translate Powered by EPO and Google, May 1, 2018, Description FR2588713, p. 1 of 1.*

(Continued)

*Primary Examiner* — Alan Cariaso

(74) *Attorney, Agent, or Firm* — Gottlieb, Rackman & Reisman, P.C.

(57) ABSTRACT

A light bar includes an elongated body, a light source within said body and connectors disposed at the ends of the body. The connectors are sized and shaped to attach the light bar to a power bar. An interference fit is provided with the power bar to maintain the light bar in place. The light bar and the power bar preferably form a part of a modular lighting system with many different types of light sources.

8 Claims, 17 Drawing Sheets

(51) Int. Cl.
*F21Y 103/10* (2016.01)
*F21V 21/104* (2006.01)

(56) References Cited

U.S. PATENT DOCUMENTS

| | | | | |
|---|---|---|---|---|
| 3,716,031 | A | 2/1973 | Rowbury | |
| 3,748,463 | A | 7/1973 | Trassinelli | |
| 4,723,747 | A | 2/1988 | Karp | |
| 4,758,935 | A | 7/1988 | Frassati et al. | |
| 4,763,870 | A | 8/1988 | Wodlinger | |
| D301,304 | S | 5/1989 | Will | |
| D317,058 | S | 5/1991 | Sonneman | |
| 5,025,355 | A * | 6/1991 | Harwood | F21S 8/06 362/147 |
| D320,465 | S | 10/1991 | Sonneman | |
| 5,065,295 | A | 11/1991 | De La Haye et al. | |
| 5,105,349 | A | 4/1992 | Falls | |
| D360,046 | S | 7/1995 | Sugiura | |
| 5,455,754 | A | 10/1995 | Hoffner | |
| D392,407 | S | 3/1998 | Johnson et al. | |
| 5,833,358 | A | 11/1998 | Patik | |
| 6,135,615 | A | 10/2000 | Lee | |
| 6,179,442 | B1 | 1/2001 | Schurle | |
| 6,241,369 | B1 | 6/2001 | MacKiewicz | |
| 6,244,733 | B1 | 6/2001 | Fong et al. | |
| 6,341,979 | B1 | 1/2002 | Yamamoto | |
| 6,409,524 | B1 * | 6/2002 | Miller | F21V 21/34 439/110 |
| 6,489,748 | B1 | 12/2002 | Okamura | |
| 6,659,623 | B2 * | 12/2003 | Friend | F21V 21/002 250/504 R |
| 6,769,790 | B2 | 8/2004 | Fruhm | |
| D507,374 | S | 7/2005 | Chen | |
| 7,172,332 | B2 | 2/2007 | Mobarak et al. | |
| 7,246,935 | B2 | 7/2007 | Benghozi et al. | |
| 7,397,384 | B1 | 7/2008 | MacKenzie, IV | |
| 7,503,778 | B2 | 3/2009 | Lehman et al. | |
| 7,507,005 | B1 | 3/2009 | Mier-Langner | |
| 7,520,762 | B2 | 4/2009 | Lehman et al. | |
| 7,520,763 | B1 | 4/2009 | Buse | |
| D595,884 | S | 7/2009 | Liao | |
| 7,563,000 | B2 | 7/2009 | Gierveld | |
| 7,571,736 | B1 | 8/2009 | Chu | |
| 7,654,834 | B1 | 2/2010 | Imier-Langner et al. | |
| D611,169 | S | 3/2010 | Harder | |
| D620,168 | S | 7/2010 | Sabernig | |
| 7,794,132 | B2 | 9/2010 | Cunius | |
| 7,798,824 | B2 | 9/2010 | Fong | |
| 7,806,913 | B2 | 10/2010 | Fanger | |
| D629,954 | S | 12/2010 | Compton | |
| D632,423 | S | 2/2011 | Canfield | |
| 7,955,125 | B1 | 6/2011 | Petrillo | |
| D648,470 | S | 11/2011 | Rains | |
| D649,692 | S | 11/2011 | Trzesniowski | |
| 8,061,865 | B2 * | 11/2011 | Piepgras | E04B 9/006 362/149 |
| 8,398,276 | B2 * | 3/2013 | Pearson | F21S 8/033 362/248 |
| D680,673 | S | 4/2013 | Levine | |
| D689,221 | S | 9/2013 | Isaac | |
| 8,523,378 | B2 | 9/2013 | Schulzman | |
| 8,584,412 | B2 | 11/2013 | Frecska et al. | |
| 8,616,871 | B2 | 12/2013 | Galomb | |
| 8,733,710 | B1 | 5/2014 | Suazo | |
| 8,794,804 | B2 | 8/2014 | Verfuerth | |
| 8,814,383 | B2 * | 8/2014 | Bizzotto | F21V 21/08 362/237 |
| 8,840,319 | B2 | 9/2014 | Hogue | |
| 8,967,573 | B2 | 3/2015 | Hemmer | |
| D739,070 | S | 9/2015 | Wilson | |
| 9,136,659 | B2 * | 9/2015 | Fishman | H01R 29/00 |
| D747,636 | S | 1/2016 | Maher | |
| 9,387,268 | B2 | 7/2016 | Farren | |
| D765,296 | S | 8/2016 | Wei | |
| 9,464,772 | B2 | 10/2016 | O'Brien et al. | |
| 9,472,912 | B2 | 10/2016 | Schirmeier | |
| D772,467 | S | 11/2016 | Sonneman | |
| D772,475 | S | 11/2016 | Sonneman | |
| D773,099 | S | 11/2016 | Sonneman | |
| D773,101 | S | 11/2016 | Sonneman | |
| D773,715 | S | 12/2016 | Sonneman | |
| D773,719 | S | 12/2016 | Sonneman | |
| D773,725 | S | 12/2016 | Sonneman | |
| D775,397 | S | 12/2016 | Sonneman | |
| D779,113 | S | 2/2017 | Sonneman | |
| D779,437 | S | 2/2017 | Sonneman | |
| D779,712 | S | 2/2017 | Sonneman | |
| D779,713 | S | 2/2017 | Sonneman | |
| D779,714 | S | 2/2017 | Sonneman | |
| D779,715 | S | 2/2017 | Sonneman | |
| D782,990 | S | 4/2017 | Sonneman | |
| 9,739,460 | B2 | 8/2017 | Haubach | |
| 9,765,954 | B2 * | 9/2017 | Zaderej | F21V 21/35 |
| 2003/0031018 | A1 | 2/2003 | Bray et al. | |
| 2003/0103347 | A1 | 6/2003 | Friend | |
| 2004/0005798 | A1 | 1/2004 | Lin | |
| 2004/0160767 | A1 | 8/2004 | Mobarak et al. | |
| 2005/0207173 | A1 | 9/2005 | Benghozi | |
| 2007/0053209 | A1 | 3/2007 | Uhler et al. | |
| 2007/0115694 | A1 | 5/2007 | Mobarak et al. | |
| 2007/0247845 | A1 | 10/2007 | Udo | |
| 2008/0190043 | A1 | 8/2008 | Beckmann | |
| 2009/0051292 | A1 | 2/2009 | Noh | |
| 2009/0123994 | A1 | 5/2009 | Lafaye et al. | |
| 2010/0271834 | A1 | 10/2010 | Muessli | |
| 2010/0271847 | A1 | 10/2010 | Mobarak et al. | |
| 2012/0257388 | A1 | 10/2012 | Bracher et al. | |
| 2014/0226315 | A1 | 8/2014 | Nicieja et al. | |
| 2015/0198311 | A1 | 7/2015 | O'Brien et al. | |
| 2015/0316238 | A1 | 11/2015 | Guilmette | |
| 2015/0338037 | A1 * | 11/2015 | Wang | F21V 21/34 362/217.14 |
| 2016/0033098 | A1 * | 2/2016 | Bergman | H02G 3/20 362/418 |
| 2017/0198892 | A1 | 7/2017 | Sonneman | |

FOREIGN PATENT DOCUMENTS

| | | | |
|---|---|---|---|
| DE | 4414046 | A1 | 10/1995 |
| DE | 29705852 | U1 | 5/1997 |
| DE | 19849101 | A1 | 4/1999 |
| DE | 202004001178 | U1 | 5/2004 |
| EP | 0320661 | A2 | 6/1989 |
| EP | 0379244 | A1 | 7/1990 |
| EP | 1757858 | A2 | 2/2007 |
| EP | 1847763 | A1 | 10/2007 |
| EP | 2821695 | A1 | 1/2015 |
| EP | 3196547 | A1 | 7/2017 |
| FR | 608 016 | A | 7/1926 |
| FR | 2588713 | A1 | 4/1987 |
| WO | 2016/132361 | A1 | 8/2016 |

OTHER PUBLICATIONS

USPTO, Non-Final Office Action dated Jan. 13, 2017 issued in corresponding U.S. Appl. No. 15/251,369.

USPTO, Non-Office Action dated Mar. 3, 2017 issued in corresponding U.S. Appl. No. 15/255,289.

USPTO, Non-Final Office Action dated Mar. 7, 2017 issued in corresponding U.S. Appl. No. 15/287,897.

USPTO, Non-Final Office Action dated Feb. 10, 2017 issued in corresponding U.S. Appl. No. 15/286,977.

USPTO, Non-Final Office Action dated Mar. 1, 2017 issued in corresponding U.S. Appl. No. 15/378,207.

USPTO, Non-Final Office Action dated Dec. 22, 2016 issued in corresponding U.S. Appl. No. 15/197,919.

USPTO, Final Office Action dated Apr. 5, 2017 issued in corresponding U.S. Appl. No. 15/197,919.

EPO, Extended European Search Report dated Jun. 26, 2017 issued in corresponding European Patent Application No. 171506868.8.

USPTO, Non-Final Office Action dated Aug. 18, 2017 issued in corresponding U.S. Appl. No. 15/584,171.

(56) References Cited

OTHER PUBLICATIONS

USPTO, Final Office Action dated Jun. 6, 2017 issued in corresponding U.S. Appl. No. 15/251,369.
USPTO, Final Office Action dated Sep. 7, 2017 issued in corresponding U.S. Appl. No. 15/287,897.
Non-Final Office Action dated Dec. 6, 2017 issued in corresponding U.S. Appl. No. 15/446,302.
Non-Final Office Action dated Dec. 22, 2017 issued in corresponding U.S. Appl. No. 15/584,171.
Final Office Action dated Dec. 29, 2017 issued in corresponding U.S. Appl. No. 15/287,897.
Non-Final Office Action dated Jan. 12, 2018 issued in corresponding U.S. Appl. No. 15/801,855.
Non-Final Office Action dated Jan. 11, 2018 issued in corresponding U.S. Appl. No. 15/801,893.
Non-Final Office Action dated Jan. 11, 2018 issued in corresponding U.S. Appl. No. 15/808,109.
EPO, Extended European Search Report dated Jan. 3, 2018 issued in corresponding European Patent Application No. 17200563.9.
EPO, Extended European Search Report dated Jan. 5, 2018 issued in corresponding European Patent Application No. 17200550.6.
Non-Final Office Action dated Jan. 17, 2018 issued in corresponding U.S. Appl. No. 15/427,217.
Extended European Search Report dated Mar. 27, 2018 issued in corresponding European Patent Application No. 17200553.0 filed Nov. 8, 2017.
Extended European Search Report dated Mar. 28, 2018 issued in corresponding European Patent Application No. 17200535.7 filed Nov. 8, 2017.
Extended European Search Report dated Mar. 28, 2018 issued in corresponding European Patent Application No. 17200541.5 filed Nov. 8, 2017.
Partial European Search Report dated Apr. 24, 2018 issued in corresponding European Patent Application No. 17200544.9 filed Nov. 8, 2017.

* cited by examiner

LIGHT BAR FOR A LIGHTING SYSTEM

CROSS-REFERENCE TO RELATED APPLICATION

This application claims priority to U.S. Provisional Patent Application No. 62/419,505, filed Nov. 9, 2016, which is incorporated herein by reference in its entirety.

FIELD OF THE INVENTION

This invention pertains to a modular lighting system that includes components that can be assembled to form multi-level lights of various sizes, shapes and configurations, and more particularly to a horizontal linear light bar attached to one of the power bars of the modular lighting system.

BACKGROUND OF THE INVENTION

Designing lighting for a space has always been a challenge because lighting equipment has to meet utilitarian, technical and aesthetic needs. Thus, any such endeavor is successful only if combining technical, architectural and artistic skills.

Several different types of ceiling lights are presently available, including surface mounted lights, recessed lights and hanging lights. The present invention pertains to hanging lights.

SUMMARY OF THE INVENTION

The present invention is directed to a modular lighting system in which hangers are provided for hanging power bars from ceilings or other architectural surfaces.

Briefly, a modular lighting system includes canopies connectable to a power source, a plurality of horizontal bars and a plurality of hangers, including a first set of hangers that support the bars from the canopy and a second set of hangers. Each of the hangers includes a first end disposed between and engaging a bar segment. The modular lighting system further includes a plurality of pendants that are supported by the second set of hangers from the bars. The hangers and bars cooperate to provide electric power to the pendants from the canopy.

Preferably, each bar includes two bar segments that face each other and are made of a non-conductive material. Conductive rails are provided on the inner surface of each bar segment. The hangers include a base that is configured to form an interference fit with the bar segments.

In one embodiment, the hangers are made of conductive rods or cables that are in electrical contact with the rails through the respective bases.

In one embodiment, the bars are straight or linear. In another embodiment, the bars are circular or have some other curvilinear shape.

The bars preferably extend horizontally. However different bars are disposed at different heights and are supported from one or more canopies or straight from a ceiling by hangers of various configurations or cables.

Preferably, at least one of the canopies is connected to a line voltage and transformer that is used to step down the line voltage to a lower voltage such as 24 VAC which is then distributed to the pendants through the hangers and bars.

The pendants, which are shaped for heat dissipation and are driven by electric circuitry, include light emitting elements such as LEDs. Because the LEDs have a long life, they are not replaceable, but instead the whole pendant is replaced as needed.

These various elements are combined in many different ways resulting in a virtually infinite number of configurations. One configuration may include several bars disposed in a vertical plane. Another configuration may include several bars that extend at different angles in one plane and are joined at a common point. Another configuration may include a combination of the previously described configurations. Another configuration may include several bars disposed at different heights or tiers with some of the bars arranged perpendicular to other bars.

In the present disclosure, a horizontal light bar has a linear body with a first surface, a first end, a second end and a light source that is disposed in the linear body and arranged to emit light through said first surface. A first connector and a second connector are disposed at the first end and the second end. The connectors extend perpendicularly from the body. The connectors are shaped to form an interference fit with a horizontal power bar to attach the body to the horizontal power bar and to provide power from the horizontal power bar.

In one embodiment, the connectors are sized and shaped to space the linear body from the power bar when installed at a preselected distance above or below the power bar.

The first surface is preferably planar and at least partially light transmisive to allow light to exit from the light source.

The body is sized and shaped for mounting on the horizontal power bar in a first position in which light from the light source is directed upward and a second position in which light from the light source is directed downward.

In one embodiment, a modular light system includes a power bar formed from a first segment and a second segment that extend horizontally at a predetermined distance and have inner surfaces oriented vertically that are made of an electrically conductive material. A power source provides electrical current to the inner surfaces. The modular lighting system further includes a light bar that has a linear body with a first surface and first and second ends. A light source disposed in the linear body and arranged and constructed to emit light through the first surface. A first connector and a second connector are disposed at the first and second ends. The connectors extend perpendicularly from the body, the connectors are in contact with the conductive surfaces to attach the body to said horizontal power bar and provide power from the horizontal power bar to the light source.

DETAILED DESCRIPTION OF EMBODIMENTS OF THE INVENTION

Figure 1:
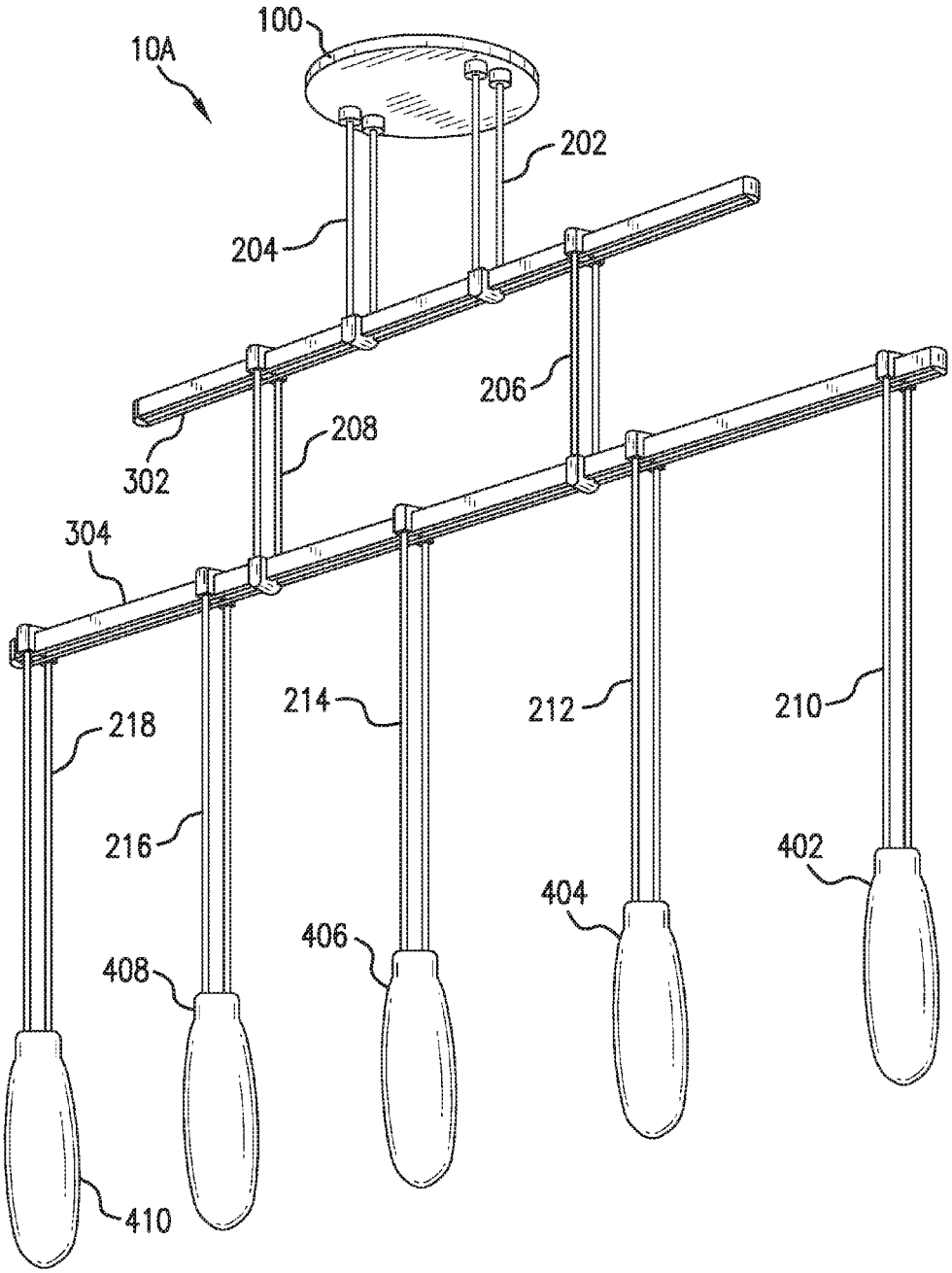
FIG. 1 is a perspective view of an embodiment of a modular lighting system of the present invention.

With reference now to the drawings, and in particular to FIGS. 1 through 5G, embodiments of modular lighting systems and elements thereof of the present invention, which is generally designated by the reference numerals 100 and 200, will be described.

Generally speaking, each modular lighting system includes one or more canopies, a plurality of hangers, a plurality of power bars and a plurality of pendants. In addition, some systems may include connectors.

Unless otherwise noted, all of the hangers and all of the power bars described herein and illustrated in the figures include two interconnected elements.

FIG. 1 shows an embodiment of a modular lighting system 10A that includes a canopy 100 that supports the modular lighting system 10A from a ceiling or other similar architectural member in a conventional manner. In this case, the canopy 100 also provides power to the modular lighting system 10A. Other, more complicated lighting systems may have several canopies that support such systems and only some or only one canopy may provide power. Here, the canopy 100 includes a conventional power supply connected to standard AC lines that provide power to LED tubes in the pendants 402, 404, 406, 408, 410 as discussed below. The power supply is hidden.

Two power feed hangers 202, 204 extend downwardly from the canopy 100. In an embodiment, each hanger discussed hereinafter includes two solid bars or rods. In another embodiment, the power feed hangers 202, 204 are replaced by multi-strand twisted steel cables.

Pendant hangers 210, 212, 214, 216, 218 are used to support a plurality of pendants 402, 404, 406, 408, 410, respectively. The pendants 402, 404, 406, 408, 410 preferably include LED bulbs that run on 24 VAC.

Preferably, one of the power feed hangers 202, 204, which includes two hanger segments, is connected to a transformer disposed within the canopy 100. In an embodiment, power from the power feed hanger 202 flows through the first power bar 302, the hanger 206, the second power bar 304 and the hangers 210, 212, 214, 216, 218 to the pendants 402, 404, 406, 408, 410, respectively. The transformer steps down the line voltage from a standard power line to 24 VAC for the pendants 402, 404, 406, 408, 410. The other power feed hanger 204 may be electrically floating. Thus, in this embodiment, all of the power bars 302, 304 carry power. However, only some of the hangers carry power.

Two different kinds of power bar hangers are provided (1) parallel hangers and (2) perpendicular hangers. Parallel hangers are used to support one power bar beneath another Perpendicular hangers are used to support one power bar from the other.

Figure 2:
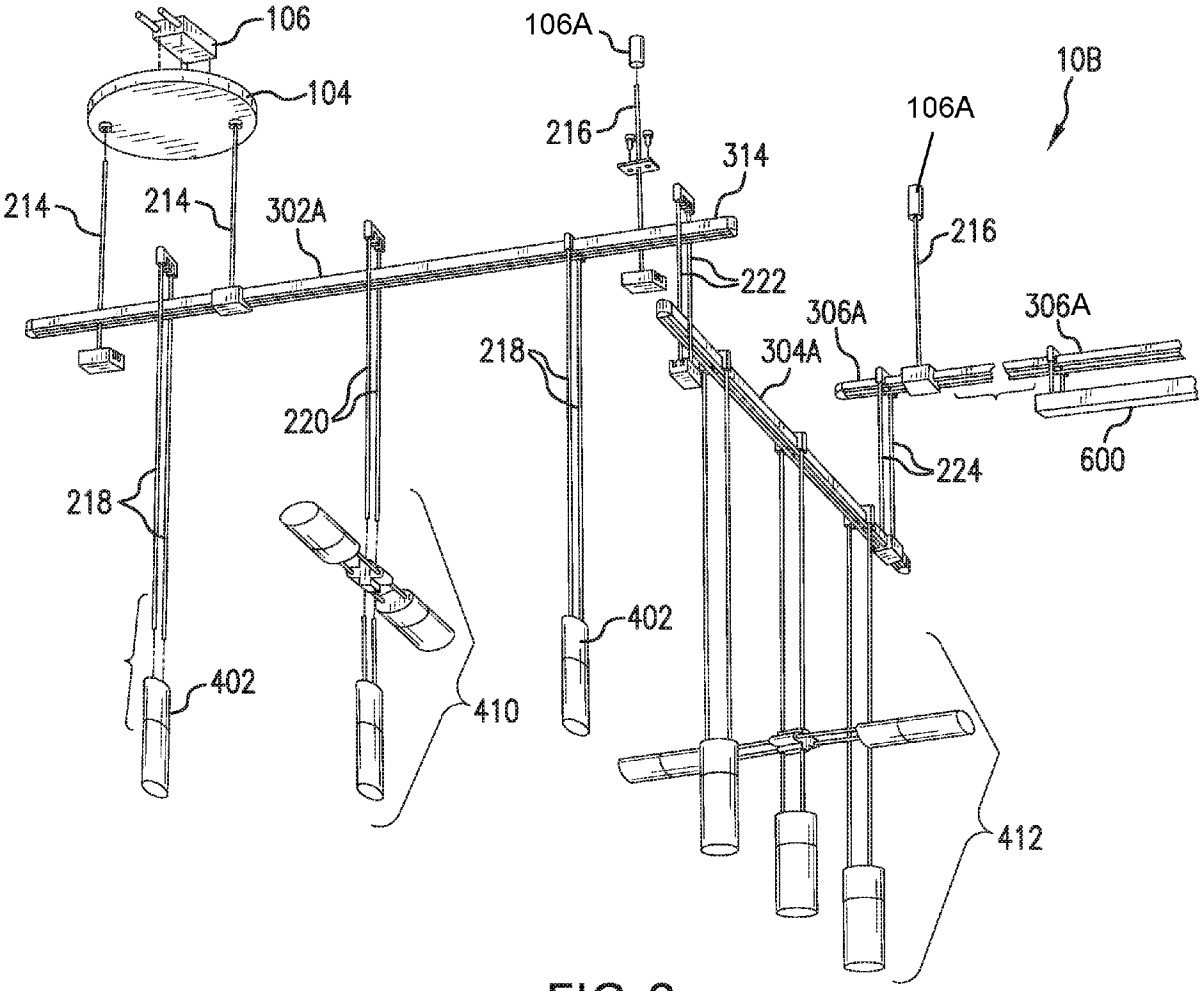
FIG. 2 is a perspective view of another embodiment of a modular lighting system of the present invention.

FIG. 2 shows an embodiment of another modular lighting system 10B. This modular lighting system 10B includes a canopy 104 with a transformer 106. Two hangers 214 extend from the canopy 104 and a first bar 302A is secured to the hangers 214. As opposed to the hangers 202, 204, 206, 208, 210, 212, 214, 216, 218 of FIG. 1 that include two vertically extending elements, the hangers 214 in FIG. 2 have a single vertically extending element, such as a rod. Each of the hangers 214 provides power to one of the elements of the first power bar 302A. However, because the first power bar 302A is not centered below the canopy 104, but rather extends in one direction away from the canopy 104, another hanger 216, which may be referred to as a ceiling hanger, is used to support a distal end 314 of the first power bar 302. The top end of the ceiling hanger 216 is attached to a sleeve 106A that is secured to the ceiling in a conventional manner.

Hangers 218 are used to attach respective pendants 402 from the first power bar 302A. Another hanger 220 is used to support a cluster of pendants 410.

The modular lighting system 10B includes second power bar 304A that is supported at one end by a hanger 222 that extends near the distal end of the first power bar 302A. The hanger 222 provides power to the second power bar 304A. A third power bar 306A is supported from the ceiling by ceiling hangers 216 (only one ceiling hanger is shown in FIG. 2 for clarity). The third power bar 306A supports the other end of the second power bar 304A and provides the second power bar 304A with power a through hanger 224 to a plurality of pendants 412. Each of the power bars 302A, 304A, 306A can be used to hang pendants of various sizes and shapes and arranged in different configurations as desired. For example, as shown in FIG. 2, a linear light bar 600 can be attached to the power bar 306A. Details of the light bar 600 are shown in FIGS. 5A-5G and are discussed in more detail below. In FIG. 2, the light bar 600 is disposed below the third power bar 306A and is configured to direct light downward. Alternatively, the light bar 600 can be disposed above the third power bar 306A and configured to direct light upward.

Figure 3A:
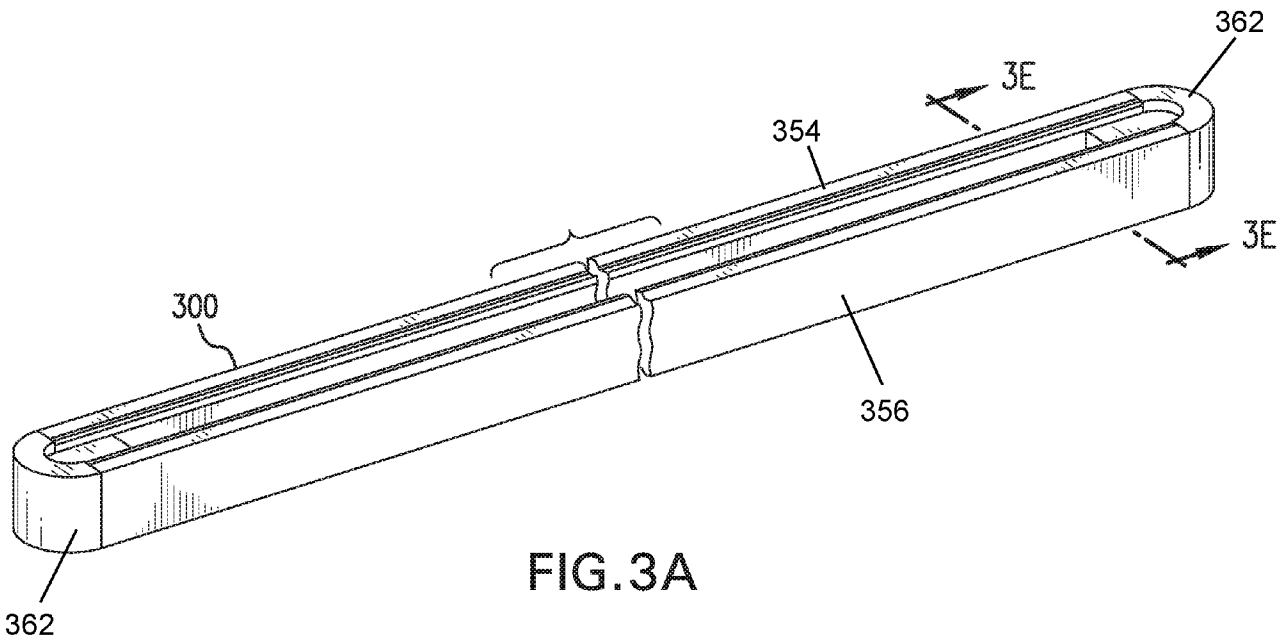
FIGS. 3A-3K are various views showing features of a power bar used in the modular lighting system of FIG. 1 or FIG. 2.
Figure 3B:
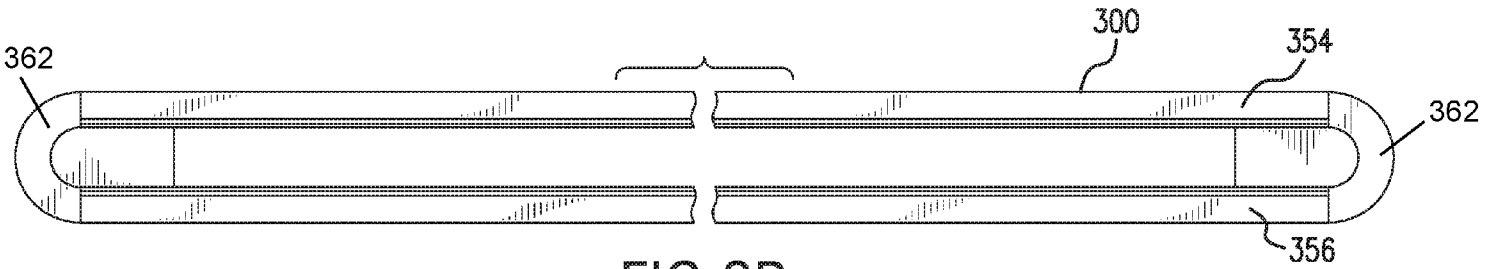
Figure 3C:
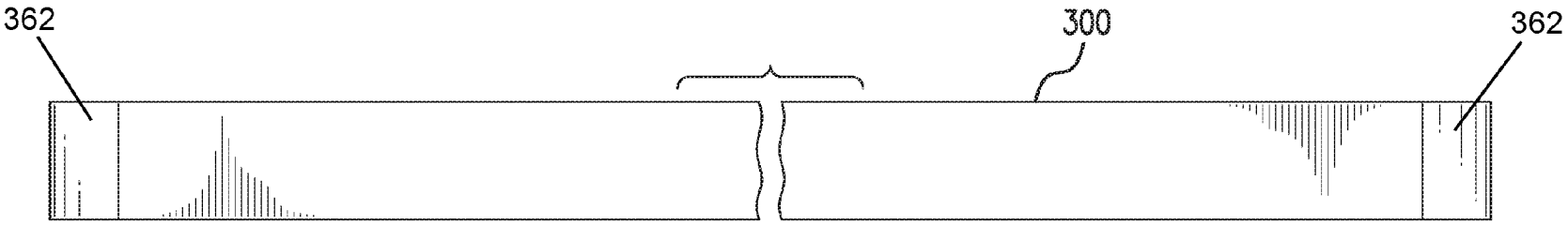
Figure 3E:
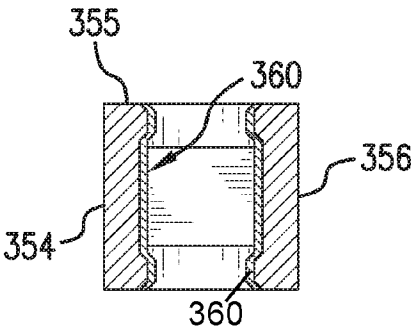
Figure 3D:
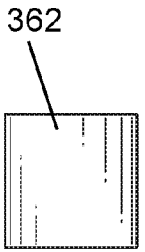
Figure 3F:
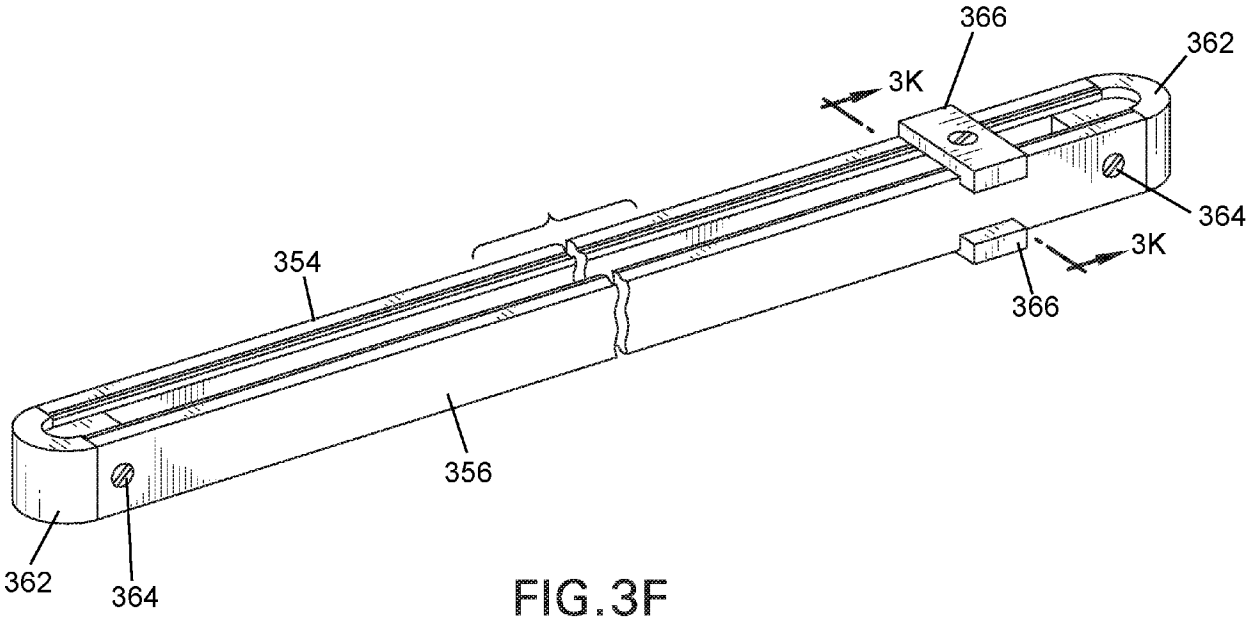
Figure 3G:
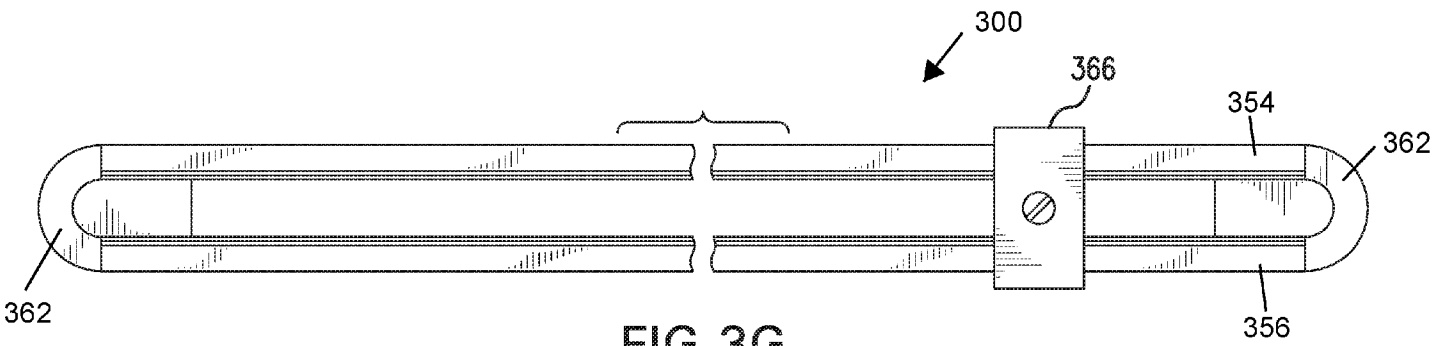

FIGS. 3A-3K show details of embodiments of a power bar 300. Unless otherwise noted, all of the power bars discussed have the same configuration. In FIGS. 3A-3K, the power bar 300 is shown as being straight, however, the power bar 300 can be circular ellipsoid or can have other geometric shape. The power bar 300 includes two identical longitudinal segments, or rail, 354, 356 that include inner surfaces that face each other. A cross-sectional view of the power bar 300 is shown in FIG. 3E. Each rail 354, 356 includes a C-shaped main body 355, 357, respectively, made of a non-conductive material, such as a plastic material that is light weight but strong so that it can support various pendants, other power bars, etc. and channels 360 that are made of a light weight conductive material such as aluminum and are fixed to or embedded into the inside surface of each rail 354, 356. Preferably, each rail 354, 356, includes a rectangular channel. The rails 354, 356 are joined together at each end by an end connector 362. The connectors 362 are attached to the rails 354, 356 by conventional means, such as screws 364, an adhesive or other means.

Figure 3H:
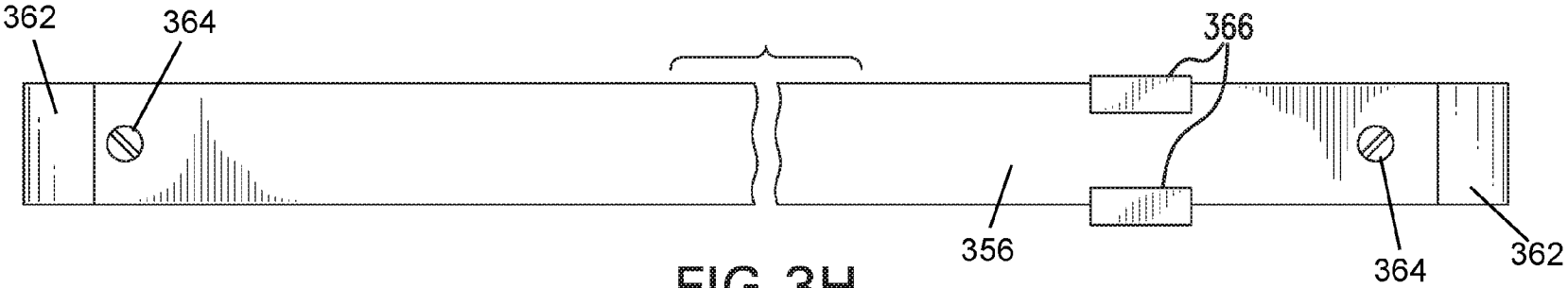
Figure 3K:
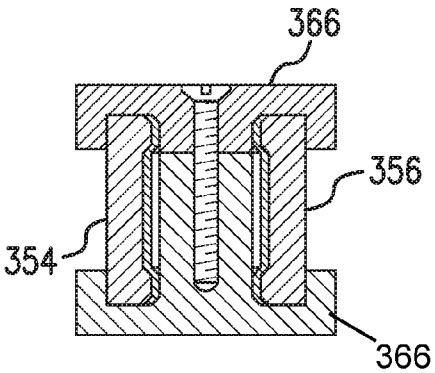
Figure 3J:
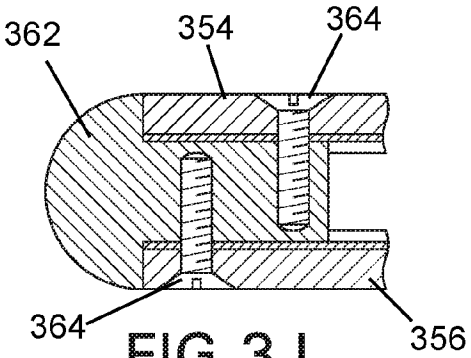
Figure 3I:
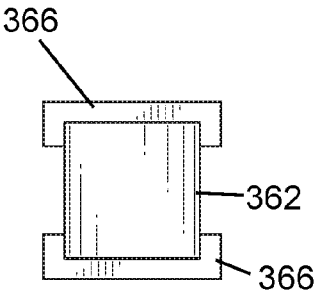

Preferably, the rails 354, 356 each have inner surfaces that are spaced at a nominal distance throughout the length of the power bar 300. The power bar 300 is made in standard lengths ranging from 12 to 48 inches. As shown in FIGS. 3H and 3K, for very long power bars, for example power bars exceeding twenty-four inches, a spacer 366 is placed between the rails 354, 356. The spacer 366 may be held in place by screws or other means.

Several types of hangers are provided including hangers for supporting bars from canopies, hangers for supporting bars from ceilings (without a power connection), hangers for supporting one bar from another bar and hangers for supporting pendants. All of these hangers must be able to interface with a bar at least at one end as described below.

There are two types of bar-to-bar hangers: (1) parallel hangers connecting two parallel bars and (2) perpendicular hangers connecting two bars running perpendicular two each other.

FIGS. 4A-4G show details of a parallel bar hanger 206 from FIG. 1. The hanger 206 extends over the first power bar 302 and is used to support the second power bar 304 by extending under the second power bar. The hanger 206 includes two vertical segments 230A, 230B. Both the top and the bottom ends of the segments 230A, 230B are imbedded in identical W-shaped bases 232, which are shown in more detail in FIGS. 4B-4G.

The base 232 forms two channels 234, 236 with a wall 232C separating the two channels 234, 236. Two metallic springs or clips 240, 242 extend outwardly from the base 232 into the channels 234, 236. One of the clips 240 is electrically attached to segment 230A within the base 232, and the other clip 242 is connected to segment 230B. Preferably, the base 232 is made of a non-conductive material and is overmolded to cover portions of the clips 240, 242 and the segments 230A, 230B. In one embodiment, both of the bases 232 between which the segments 230A, 230B extend, have a single, unitary structure. In another embodiment, at least one of the bases 232 is made of two sections 232A, 232B that snap together forming an interference fit therebetween.

Figure 4A:
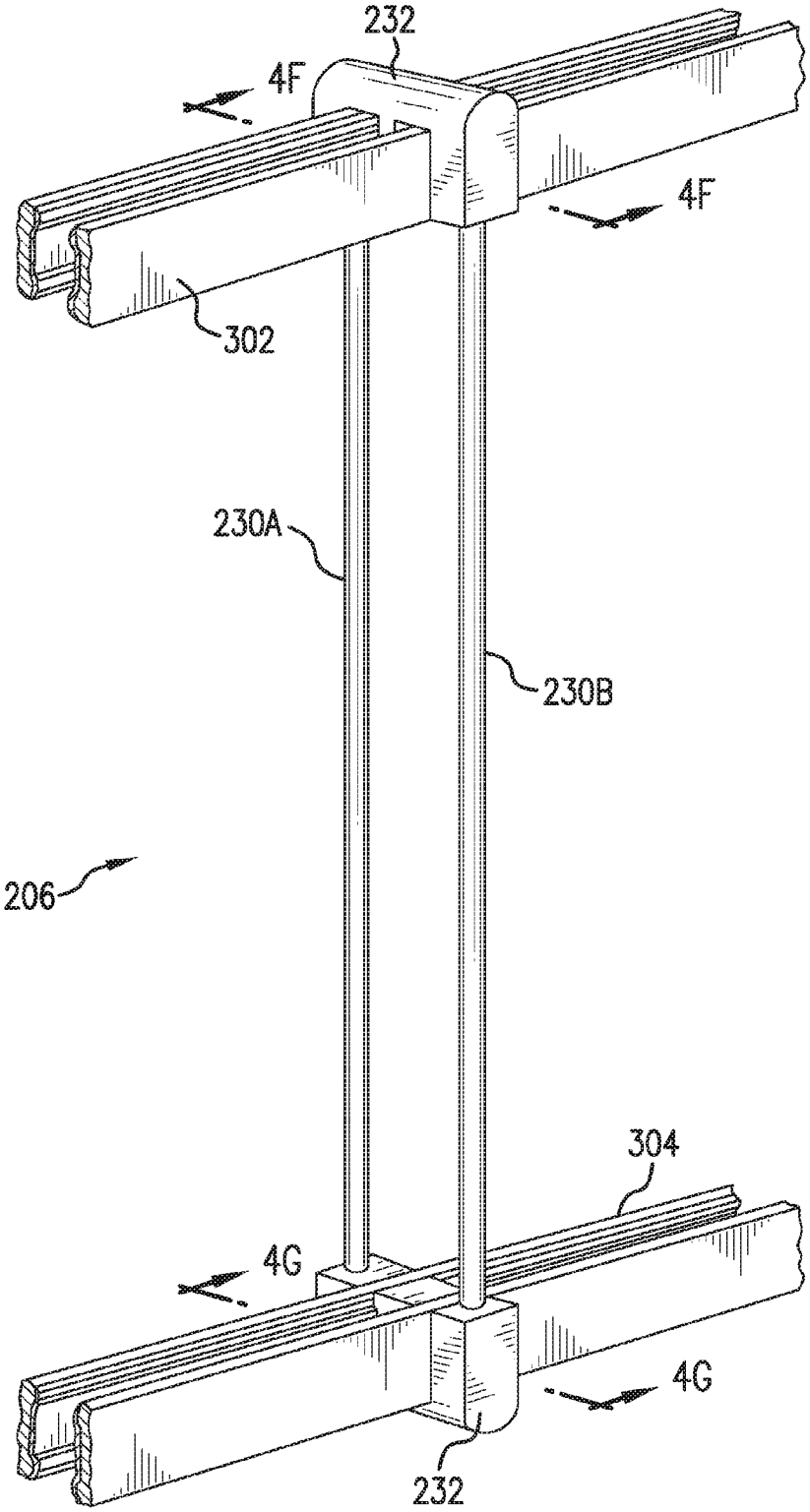
FIGS. 4A-4I are various views showing features of hangers used in the modular lighting system of FIG. 1 or FIG. 2.
Figure 4C:
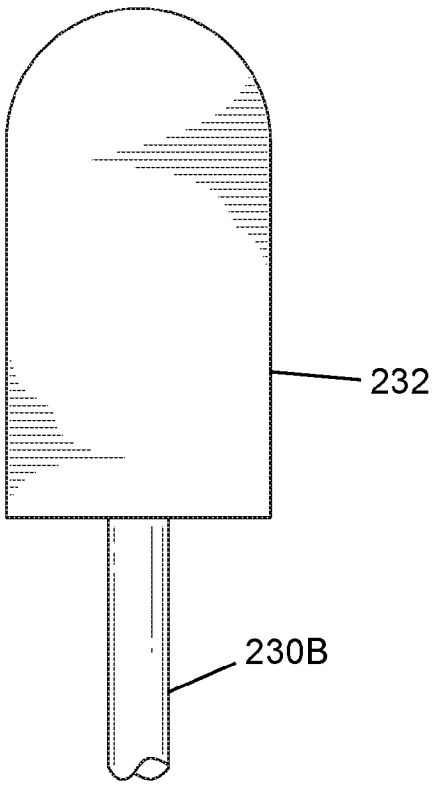
Figure 4B:
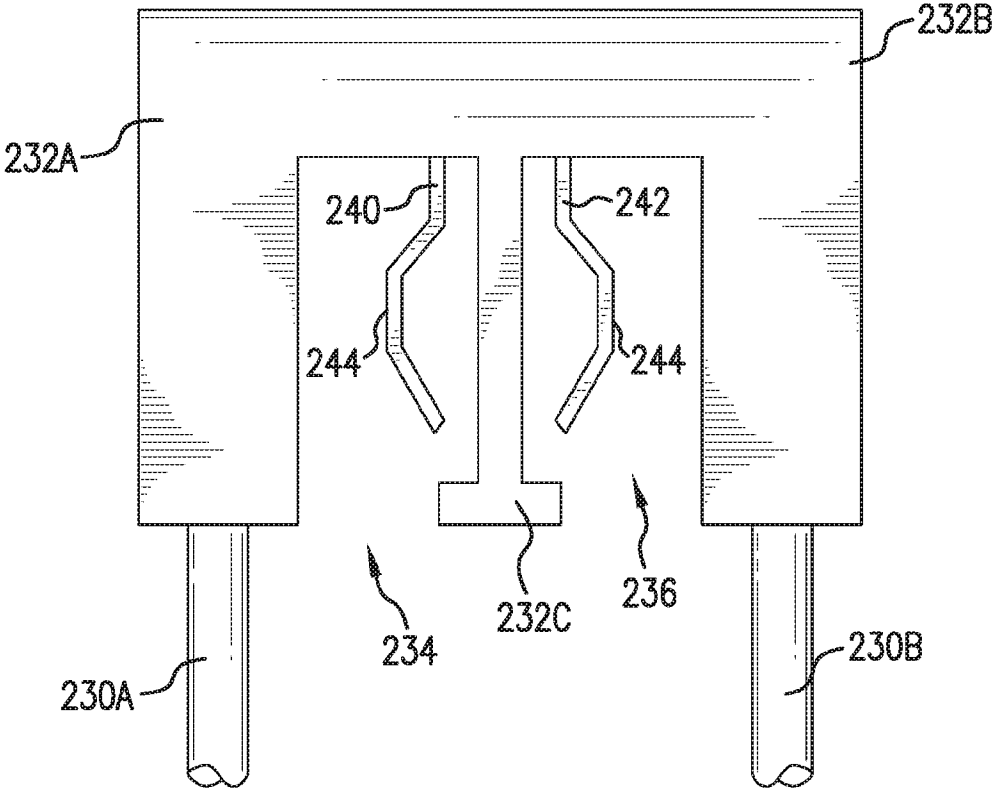
Figure 4D:
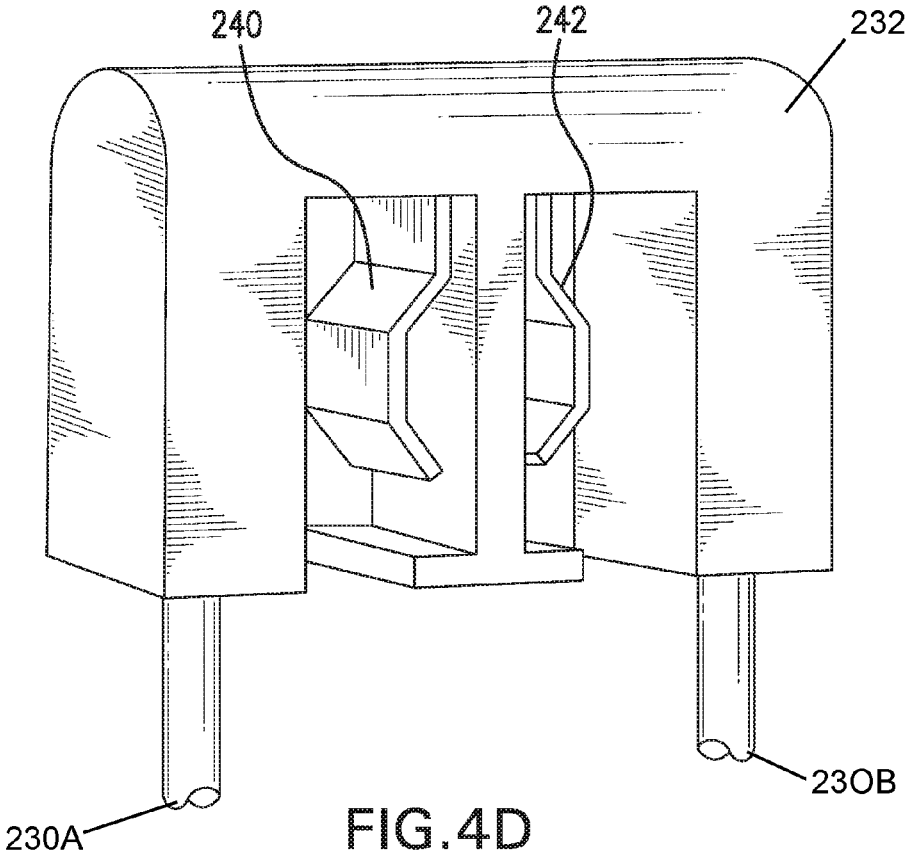
Figure 4E:
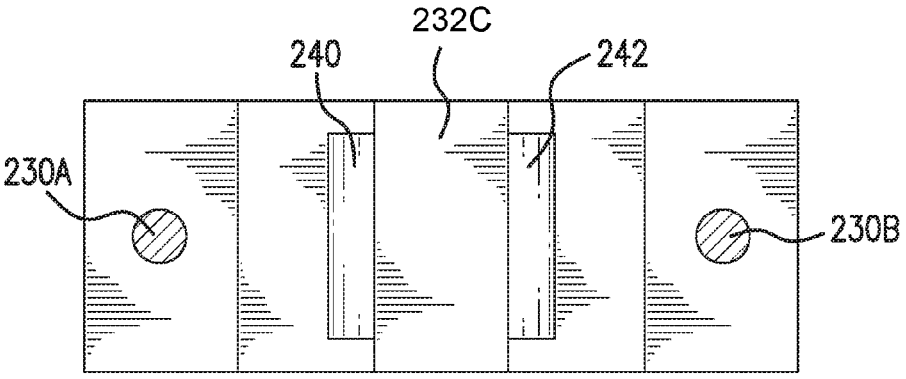
Figure 4F:
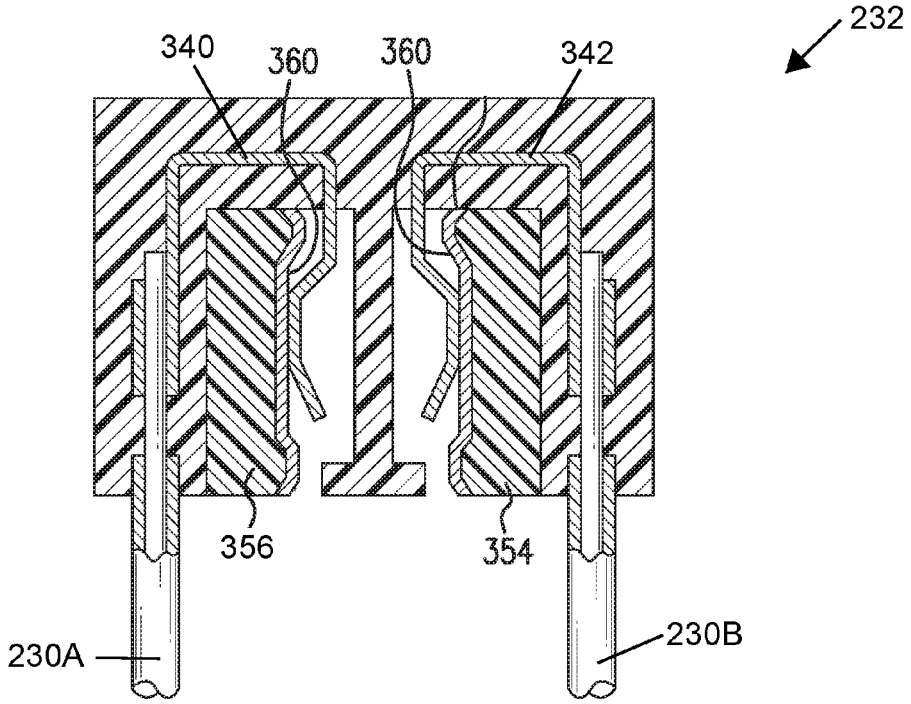
Figure 4G:
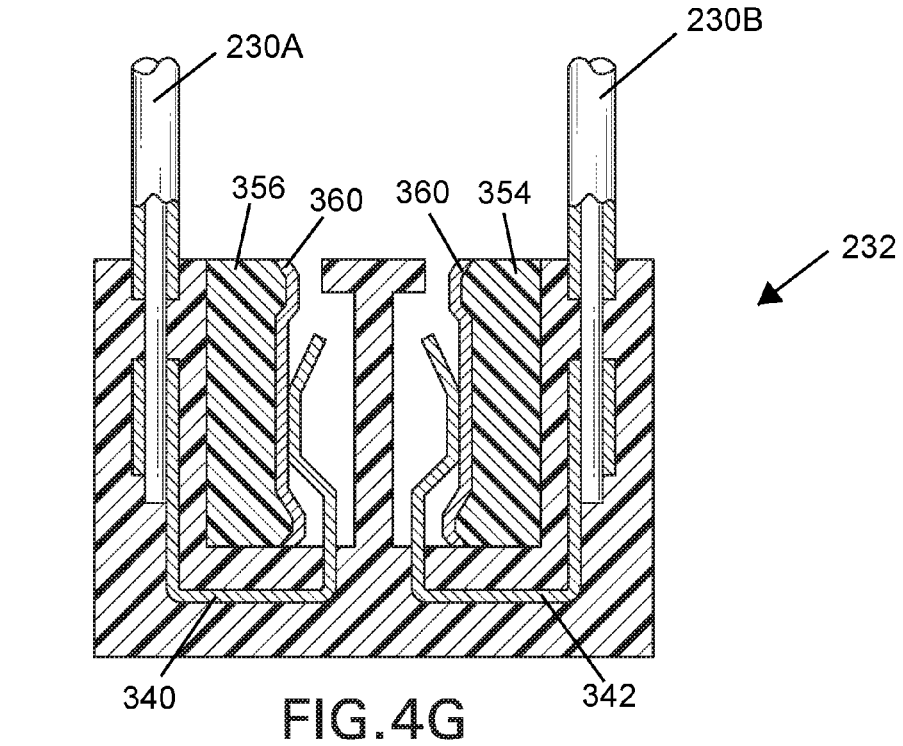
Figure 4H:
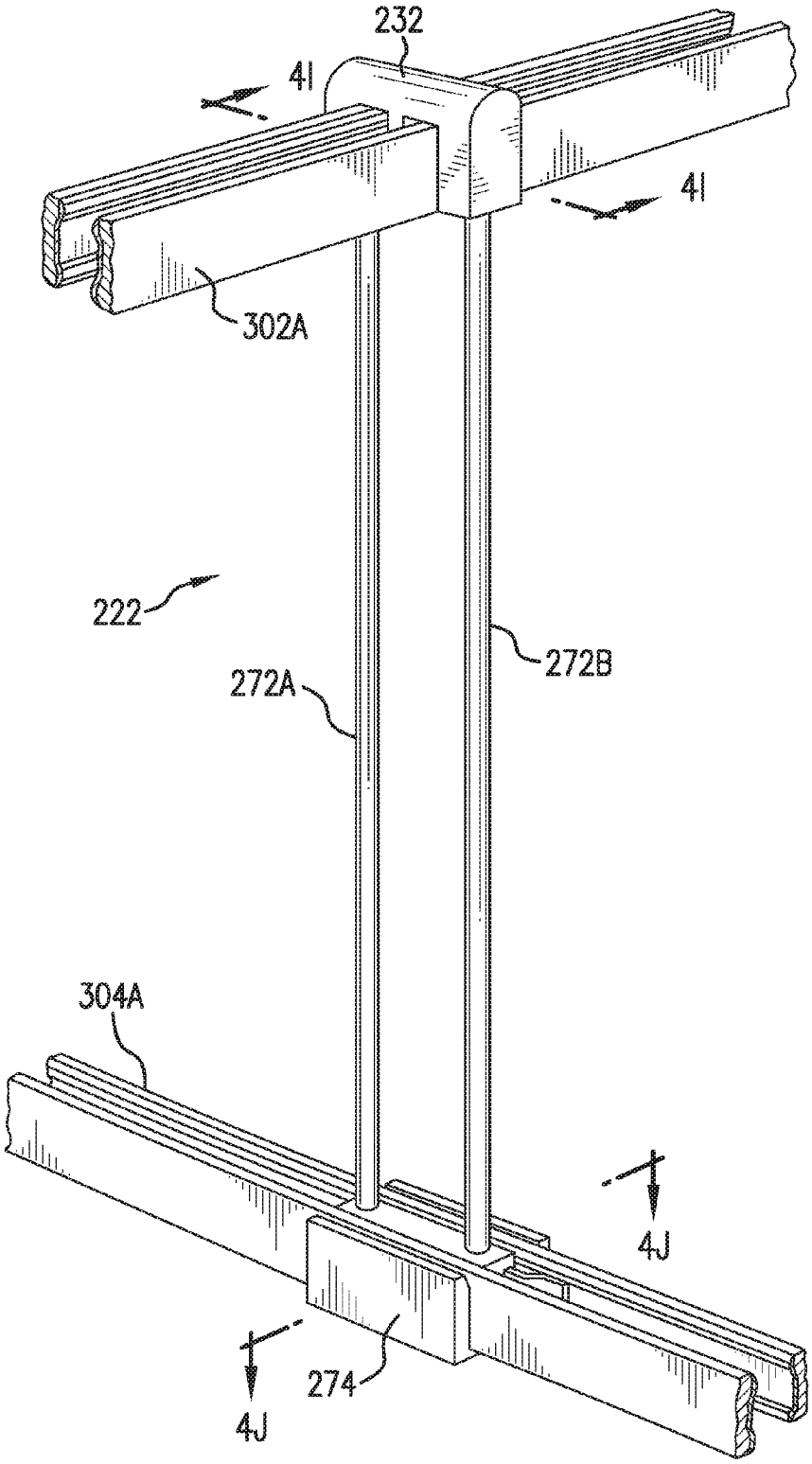

As can be seen in FIGS. 4F and 4G, the bases 232 are sized and shaped so that they fit over and engage the first power bar 302 and the second power bar 304. Importantly, the clips 240, 242 are sized and shaped so that they engage the rails 354, 356. The clips 240, 242 have flat sections 244 sized and shaped to snap into the rails 354, 356 of the first power bar 302 and the second power bar 304. In this manner, not only do the clips 240, 242 provide a solid electrical contact between flat sections 244 and the rails 354, 356, but they also stabilize the hangers on the bars and ensure that the lower bar 304 remains stiff and does move around in use. The clips 240, 242 may be made from beryllium copper.

The hanger 208 has a similar configuration, however, the clips 240, 242 need not be connected electrically to the hanger segments. For example, in the configuration shown in FIG. 2, hangers 222 do provide electrical connection to bars 304A and 306.

The hanger segments 230A, 230B are provided in various lengths as required to obtain the various systems described above, and they are preferably in the shape of rods made of a stiff but somewhat springy material having shape memory alloys such as a phosphor/bronze alloy. Preferably, except where an electrical contact is required, the rods are covered or painted with a thin electrically insulating material.

The hangers can be installed by separating the two segments 230A, 230B, passing the ends of the first power bar 302 and the second power bar 304 between the segments, then lowering or raising the power bars toward the respective bases 232 and then snapping the bases 232 onto the power bars into the configurations shown in FIGS. 4F and 4G.

Figure 4I:
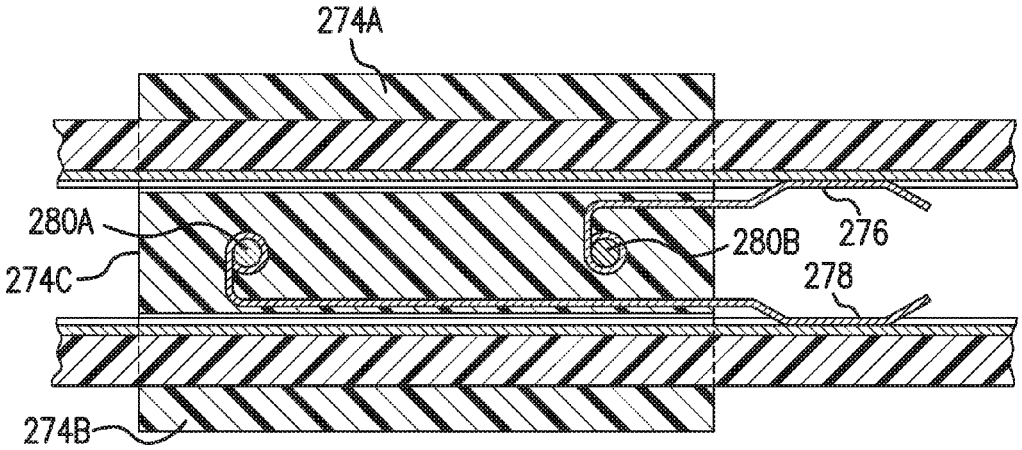

As discussed above, and illustrated in more detail below, in some instances, the power bars extend perpendicularly to each other. For example, in FIG. 2, the first power bar 302A and the second power bar 304 are perpendicular to each other. These bars are interconnected using a hanger 222 shown in FIG. 4H. The hanger 222 has two hanger segments 272A, 272B and a base 232 at the top similar to the base 232 in FIGS. 4A-4G. However, at the bottom, the hanger 222 is has a different base 274 as shown in FIG. 4I. The base 274 is formed with two side wings 274A, 274B and a center wall 274C as shown in FIG. 4I. Clips 276, 278 are provided on the center wall 274C and are connected electrically with segments 272A, 272B, respectively as shown in FIG. 4I. The center wall 274C is made with two holes 280A, 280B with the lower ends of the hanger segments 272A, 272B extending into the holes and being secured to the base 204. The base 274 is sized and shaped to engage and support the power bar 304A with the hanger segments 272A, 272B providing power to the power bar 304A. The base 232 supports the first power bar 302 and provides the similar structure as discussed above and shown in FIGS. 4B-4G.

Figure 5B:
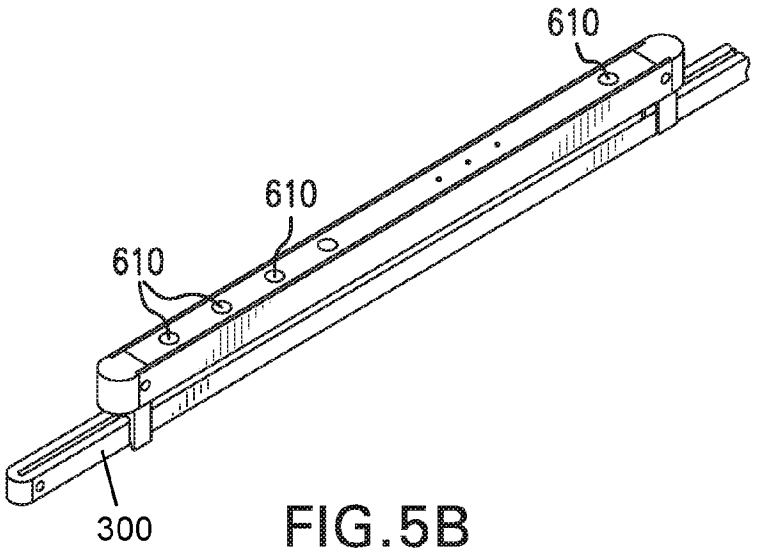
FIGS. 5A-5G are details of embodiments of light bars used in the modular lighting system of FIG. 1 or FIG. 2 and how they are dismounted from a respective power bar.
Figure 5A:
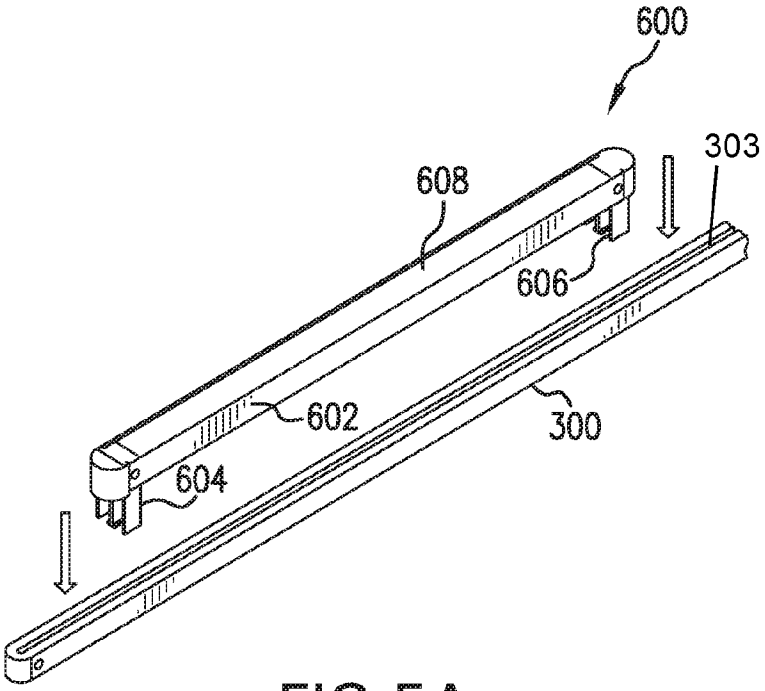
Figure 5C:
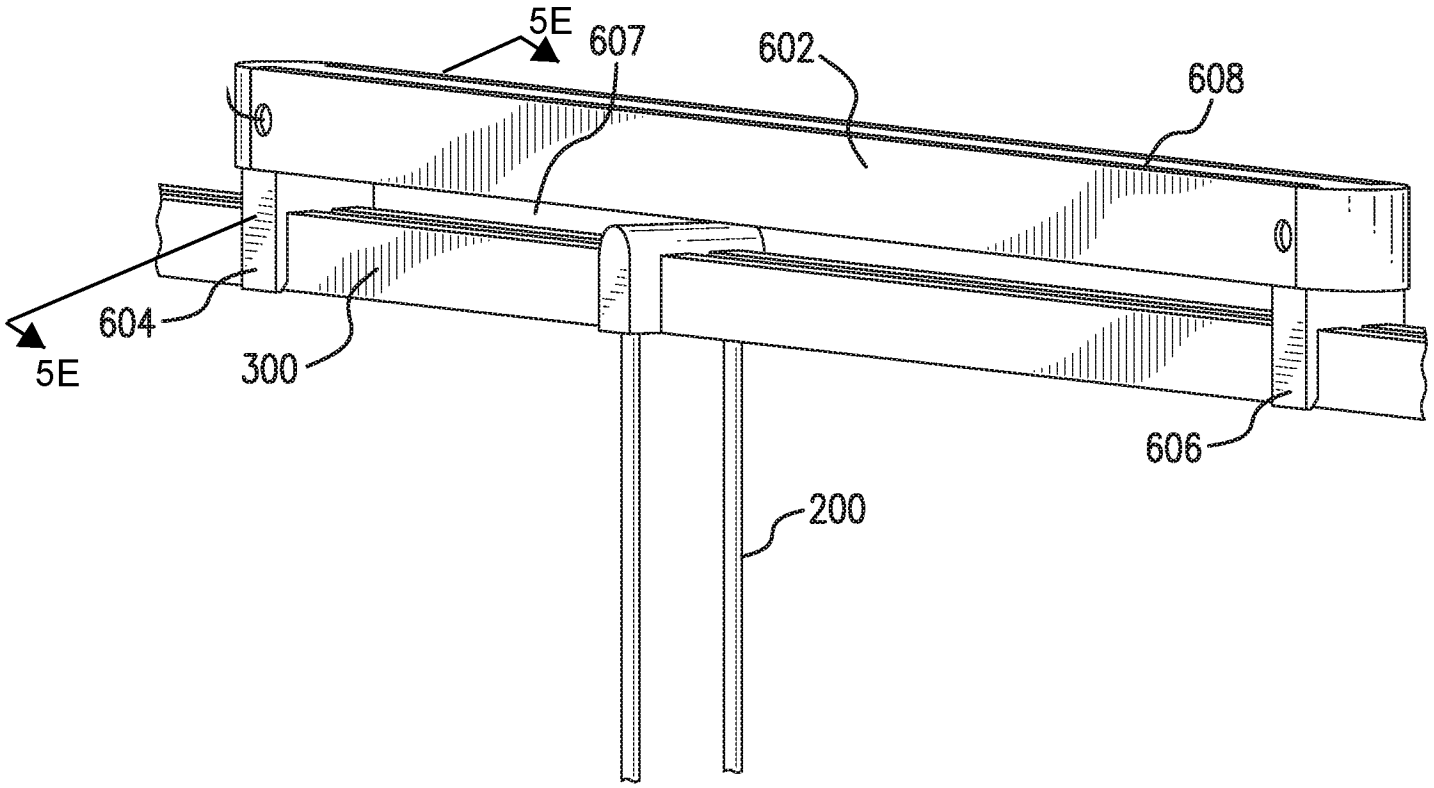
Figure 5D:
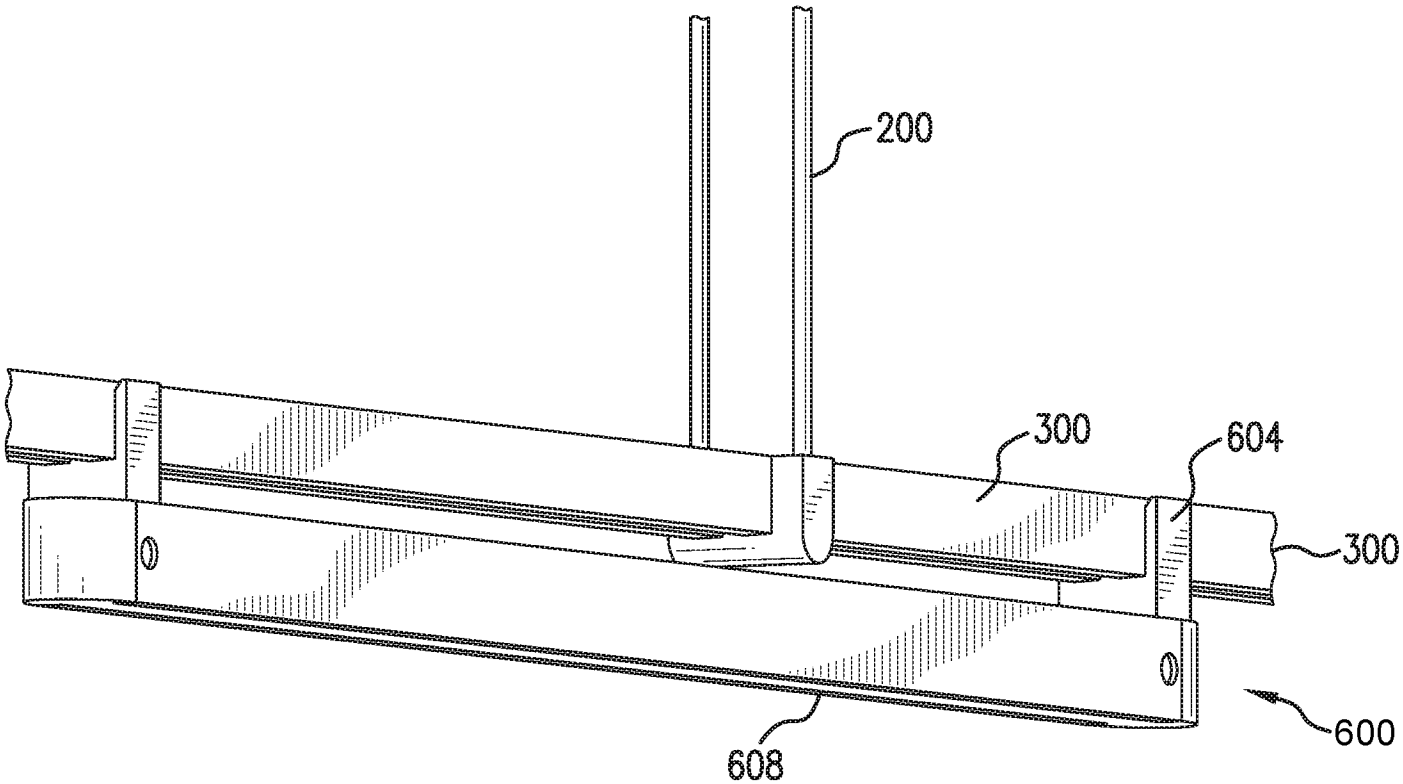

FIGS. 5A-5G show details of the light bar 600. The light bar 600 includes a substantially horizontal body 602 that is approximately the same width as the power bar 300 and includes two end connectors 604, 606. The connectors 604, 606 may have a similar structure to the base 232 shown in FIGS. 4F-4G with the clips 340, 342 configured to securely attach the light bar 600 to the power bar 300. A top surface 608 of the light bar 600 is made of a transparent or translucent material to allow light from a plurality of LEDs 610 disposed within the body 602 to emit therefrom. In the embodiment of FIGS. 5A-5C, the light bar 600 is configured to be projected upwardly. Alternatively, the light bar 600 can be turned upside down so that the LEDS 610 are pointed downwardly and the light bar 600 can be connected to the power bar 300 by pushing upward as shown in FIG. 5D. The light bar 600 can be any desired length, such as 12", 24", 36", etc.

The light bar 600 is sized and shaped so that once it is mounted on the power bar 300, a sufficient gap 607 is formed therebetween for a hanger 200 to be arranged between the power bar 300 and the light bar 600 as shown in FIG. 5C.

Figure 5E:
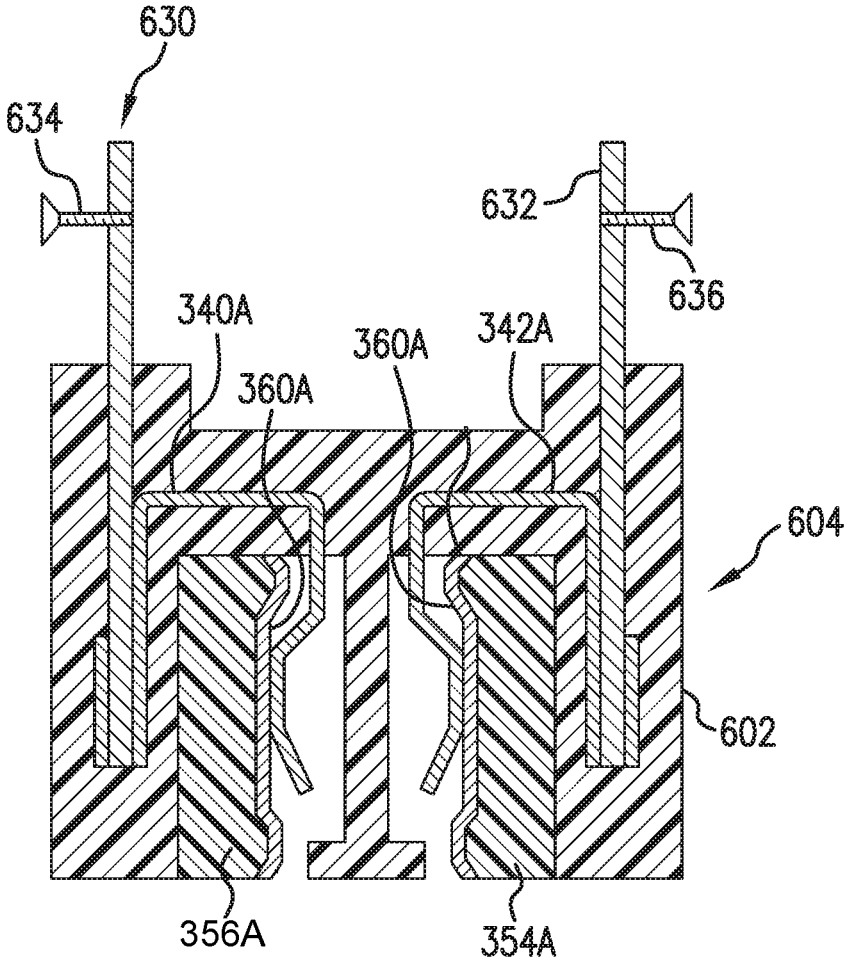

Referring now to FIG. 5E, shows a cross-sectional view of the connector 604 that has a similar structure to the connector base 232 shown in FIG. 4F. Clips 340A, 342A and rails 354A, 356A have the same shape and function as the clips 340, 342, the rails 354, 356 and the channel 360 in FIG. 4G. However, in FIG. 5E clips 340A, 342A are mechanically and electrically connected to respective blades 630, 632 that rise straight up and are provided at their upper ends with screws 634, 636. When the light bar 600 is assembled, the blades 630, 632 slip into the body of the light bar 600 (through suitable holes, not shown) and are attached thereto by the screws 634, 636. The blades 630, 632 are connected by other members (or via screws 634, 636) electrically to a circuit board and provide power to the LEDs 610.

The connector 606 has a similar structure to the connector 604, but does not provide electrical power and is used to engage the inner rails of the power bar 300 and support the light bar 600 on the power bar 300. The light bar 600 is installed in the configuration of either FIG. 5C or FIG. 5D by pressing the body 602 toward the power bar 300 as shown in FIG. 5A with the connectors 604, 606 entering a gap 303 and engaging the rails within the power bar 300. These components are shaped to form an interference fit between the clips 340A, 342A and the rails 354A, 356A.

Figure 5G:
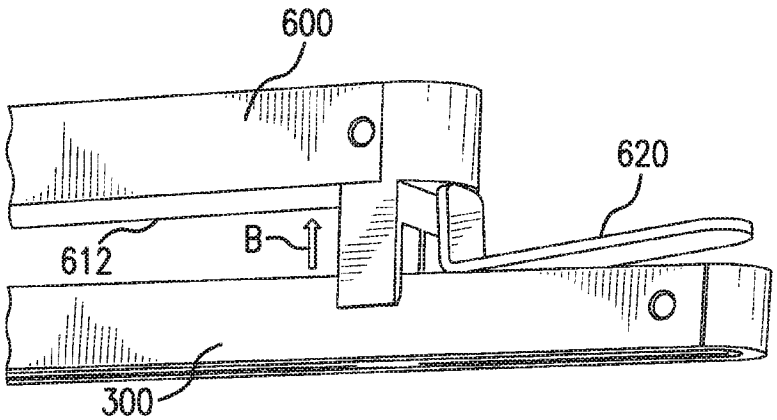
Figure 5F:
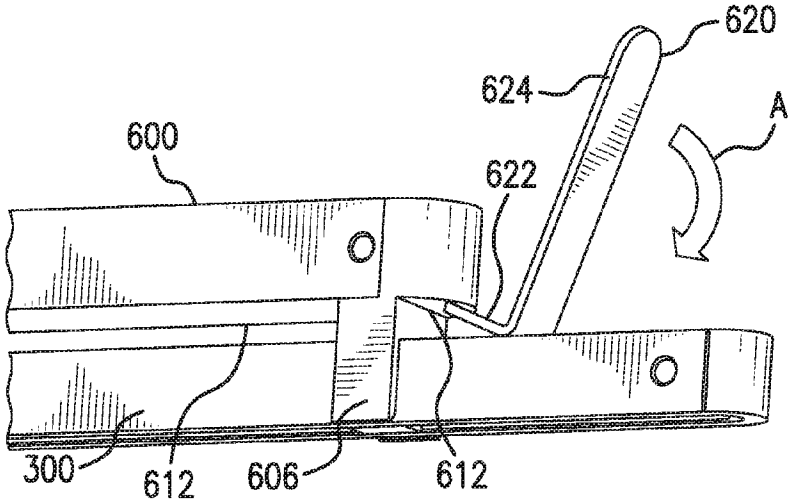

In order to achieve easy removal of the light bar 600, an L-shaped tool 620 is used. The tool 620 has two legs 622, 624 as shown in FIGS. 5F and 5G. The tool 620 is wider than the gap 303 of the bar 300 so it can be placed on top of the bar 300. The tool 620 is then positioned in order for the leg 622 to come in contact with a bottom surface 612 of the light bar 600. Pushing the tool 620 in direction A causes the tool 620 to lift the light bar 600 up and away from the power bar 300 as shown by arrow B.

The light bar 600 has been described as being attached to the power bar 300 of a modular lighting system shown in FIGS. 1-4H. However, the light bar 600 can be used in any other lighting system as well.

Numerous modifications may be made to this invention without departing from its scope as defined in the appended claims.

What is claimed is:

1. A light bar, comprising:

a linear body having a first surface and first and second ends;

a light source disposed in said linear body and arranged and constructed to emit light through said first surface; and a first connector and a second connector disposed at said first and second ends, said connectors extending perpendicularly from said body, said connectors being shaped to form an interference fit with a horizontal power bar to attach said body to the horizontal power bar and provide power from the horizontal power bar, wherein said body is sized and shaped for mounting on the horizontal power bar in a first position in which light from said light source is directed upward from said light source and a second position in which light from said light source is directed downward.

2. The light bar of claim 1, wherein said connectors are sized and shaped to space said linear body from the power bar when installed.

3. The light bar of claim 1, wherein said first surface is planar and at least partially light transmissive to allow light to exit from said light source.

4. A modular light system, comprising:

a power bar formed of a first and a second segment extending at preselected distance from each other and having inner surfaces oriented vertically and made of an electrically conductive material;

a power source providing electrical current to said inner surfaces; and a light bar including a linear body having a first surface and first and second ends;

a light source disposed in said linear body and arranged and constructed to emit light through said first surface; and a first connector and a second connector disposed at said first and second ends, said connectors extending from said body, said connectors being connected to said conductive surfaces to attach said body to said horizontal power bar and provide power from the horizontal power bar to said light source, wherein said body is sized and shaped for mounting on the horizontal power bar in a first position in which light from said light source is directed upward from said light source and a second position in which light from said light source is directed downward.

5. The light system of claim 4, wherein said connectors are sized and shaped to space said body.

6. The light system of claim 4, wherein said first surface is at least partially light transmisive to allow light to exit from said light source.

7. The light system of claim 4, wherein said light bar and said power bar are constructed and arranged for selectively couple and decouple said light bar from said power bar.

8. The light system of claim 4, further comprising a tool for selectively separating said light bar from said power bar.

* * * * *